US007377718B2

(12) United States Patent
Russo

(10) Patent No.: US 7,377,718 B2
(45) Date of Patent: May 27, 2008

(54) RETRACTABLE DELINEATOR POST

(75) Inventor: Michael A. Russo, Johnstown, NY (US)

(73) Assignee: Grid Pro Systems, Inc., Middle Grove, NY (US)

( * ) Notice: Subject to any disclaimer, the term of this patent is extended or adjusted under 35 U.S.C. 154(b) by 0 days.

(21) Appl. No.: 11/304,027

(22) Filed: Dec. 15, 2005

(65) Prior Publication Data

US 2006/0127173 A1 Jun. 15, 2006

Related U.S. Application Data

(60) Provisional application No. 60/636,348, filed on Dec. 15, 2004.

(51) Int. Cl.
*E01F 9/017* (2006.01)
*E01F 9/019* (2006.01)

(52) U.S. Cl. ..... 404/11

(58) Field of Classification Search ..... 404/9–11
See application file for complete search history.

(56) References Cited

U.S. PATENT DOCUMENTS 3,530,775 A 9/1970 Bowersox
4,576,508 A 3/1986 Dickinson
4,595,312 A * 6/1986 Corless ..... 404/11
4,861,185 A 8/1989 Eikelenboon
5,215,499 A * 6/1993 Eberhardt ..... 454/256
5,425,595 A * 6/1995 Roper ..... 404/9
5,462,384 A * 10/1995 Arlandis ..... 404/6
5,466,088 A * 11/1995 Nasatka ..... 404/6
5,476,338 A * 12/1995 Alberts ..... 404/6
5,499,887 A 3/1996 Verra
5,560,733 A 10/1996 Dickinson
6,099,200 A 8/2000 Pepe et al.
6,349,503 B1 * 2/2002 Gompertz et al. ..... 49/34
6,626,606 B1 9/2003 Johnson

FOREIGN PATENT DOCUMENTS

AU 9745328 A * 6/1999
GB 2267923 A * 12/1993

* cited by examiner

*Primary Examiner*—Raymond W Addie
(74) *Attorney, Agent, or Firm*—Hodgson Russ LLP

(57) ABSTRACT

An automatic retractable delineator with a housing containing a reciprocating delineator post that reciprocates through an opening in the top surface of the housing. A raising and lowering mechanism is disposed inside the housing and is mechanically coupled to the post. The housing defines an inside cavity that is provided with positive pressure to create a pressure differential between the cavity and the atmosphere. As a result, the housing is substantially protected from the elements as the pressure differential prevents foreign objects and moisture such as dirt, salt, ice, snow or the like from entering the cavity.

18 Claims, 5 Drawing Sheets

RETRACTABLE DELINEATOR POST

CROSS-REFERENCE TO RELATED APPLICATIONS

This application claims benefit of U.S. provisional patent application Ser. No. 60/636,348 filed Dec. 15, 2004, and entitled "Retractable Delineator" which is incorporated herein by reference.

BACKGROUND OF THE INVENTION

There is a need for a retractable traffic control device suitable for use in tollways, parking garages, road diversion, lane closures, parking ramp control, or the like that is durable, resistant to the elements and easy to install.

SUMMARY OF THE INVENTION

The present invention meets the above-described need by providing an automatic retractable delineator with a housing containing a reciprocating delineator post that reciprocates through an opening in the top surface of the housing. A raising and lowering mechanism is disposed inside the housing and is mechanically coupled to the post. The housing defines an inside cavity that is provided with positive pressure to create a pressure differential between the cavity and the atmosphere. As a result, the housing is substantially protected from the elements as the pressure differential prevents foreign objects and moisture such as dirt, salt, ice, snow or the like from entering the cavity.

BRIEF DESCRIPTION OF THE DRAWINGS

The invention is illustrated in the drawings in which like reference characters designated the same or similar parts throughout the figures of which.

DETAILED DESCRIPTION OF THE INVENTION

Figure 1:
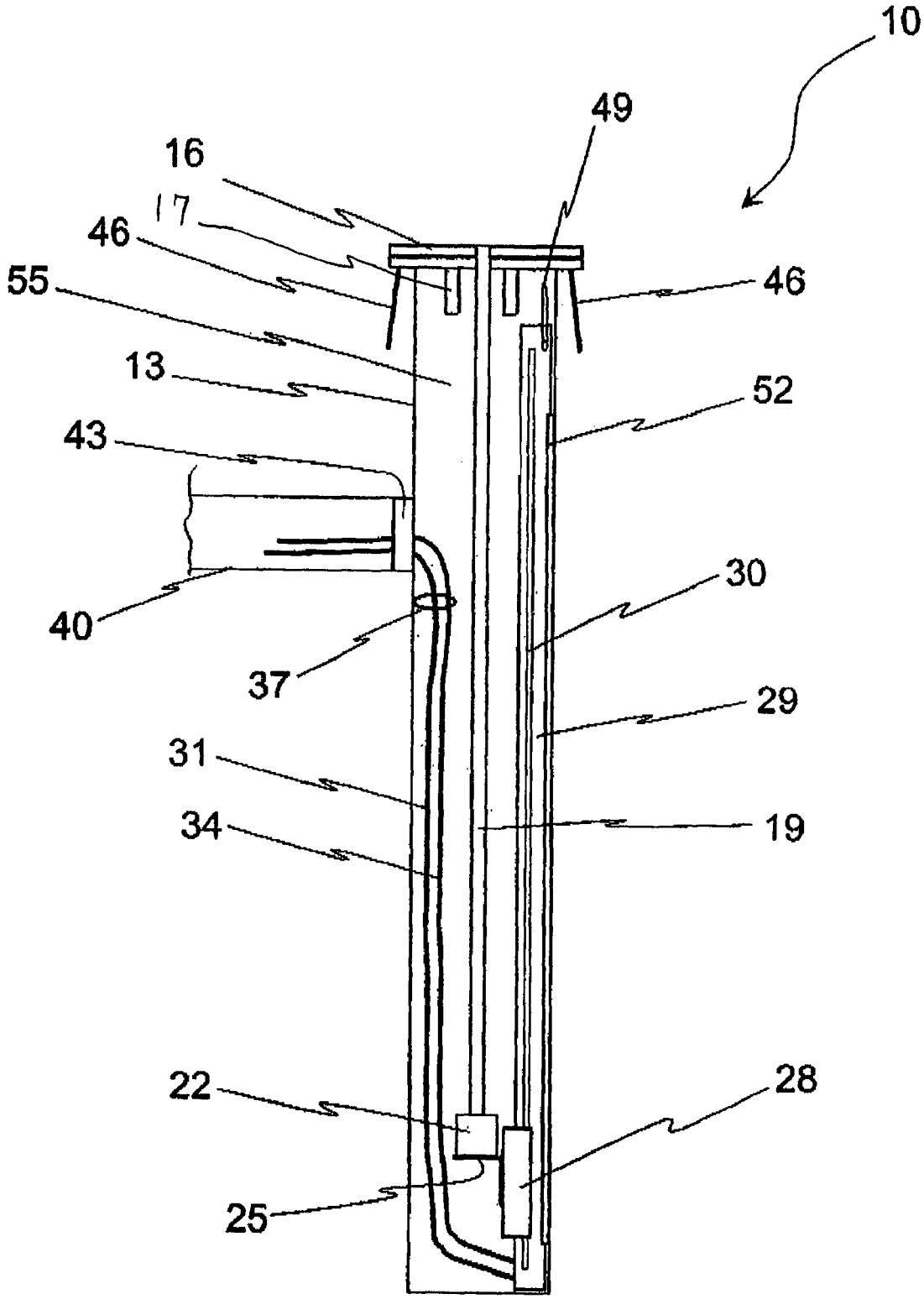
FIG. 1 is a side elevation view of a retractable delineator in a fully retracted position.

Referring to FIGS. 1-5 generally, and initially to FIG. 1, a retractable delineator 10 may be utilized to alter the flow of vehicular traffic. The retractable delineator 10 has a housing 13 which is formed as an elongate hollow structure constructed of materials suitable for outdoor installation. The housing 13 is covered by a top plate 16 through which a post 19 may be raised or lowered in order to affect or control traffic conditions. The top plate 16 has an opening associated with it such that the post 19 can extend through the opening into a space above the housing 13. Extending downward from the top plate 16, a hollow stub 17 may be positioned around the opening to provide for stabilizing the post 19. The stub 17 also provides for isolation of the mechanism inside the housing 13 to prevent damage to the mechanism from occurring if the post 19 is struck by a vehicle. When the post 19 is fully extended through the opening, a base 22 is surrounded by the stub 17. The post 19 is connected to the base 22 which is mounted upon a bracket 25. The post 19 will break away from the base 22 upon impact and the stub will prevent the base 22 from moving or transmitting force to the remainder of the mechanism. The bracket 25 is attached to a guide 28 which is able to slide vertically along a lift rail 30, thereby raising or lowering the post 19. The drive system may be a rodless cylinder 29 which contains the guide 28 and the lift rail 30.

To raise the post 19, compressed air may be passed through an air line 31 which is connected to the rodless cylinder 29. Similarly, to lower the post 19, compressed air may be passed through an air line 34, thus causing the guide 28 to be lowered along the lift rail 30. In the example shown, the drive system is a rodless pneumatic cylinder which is commercially available from Bosch Rexroth Ag of Germany. Other means for raising and lowering the post 19 such as hydraulic drives, mechanical drives, or the like would also be suitable. The various ways to accomplish the reciprocating motion of the post 19 will be evident to those of ordinary skill in the art based on this disclosure.

Figure 2:
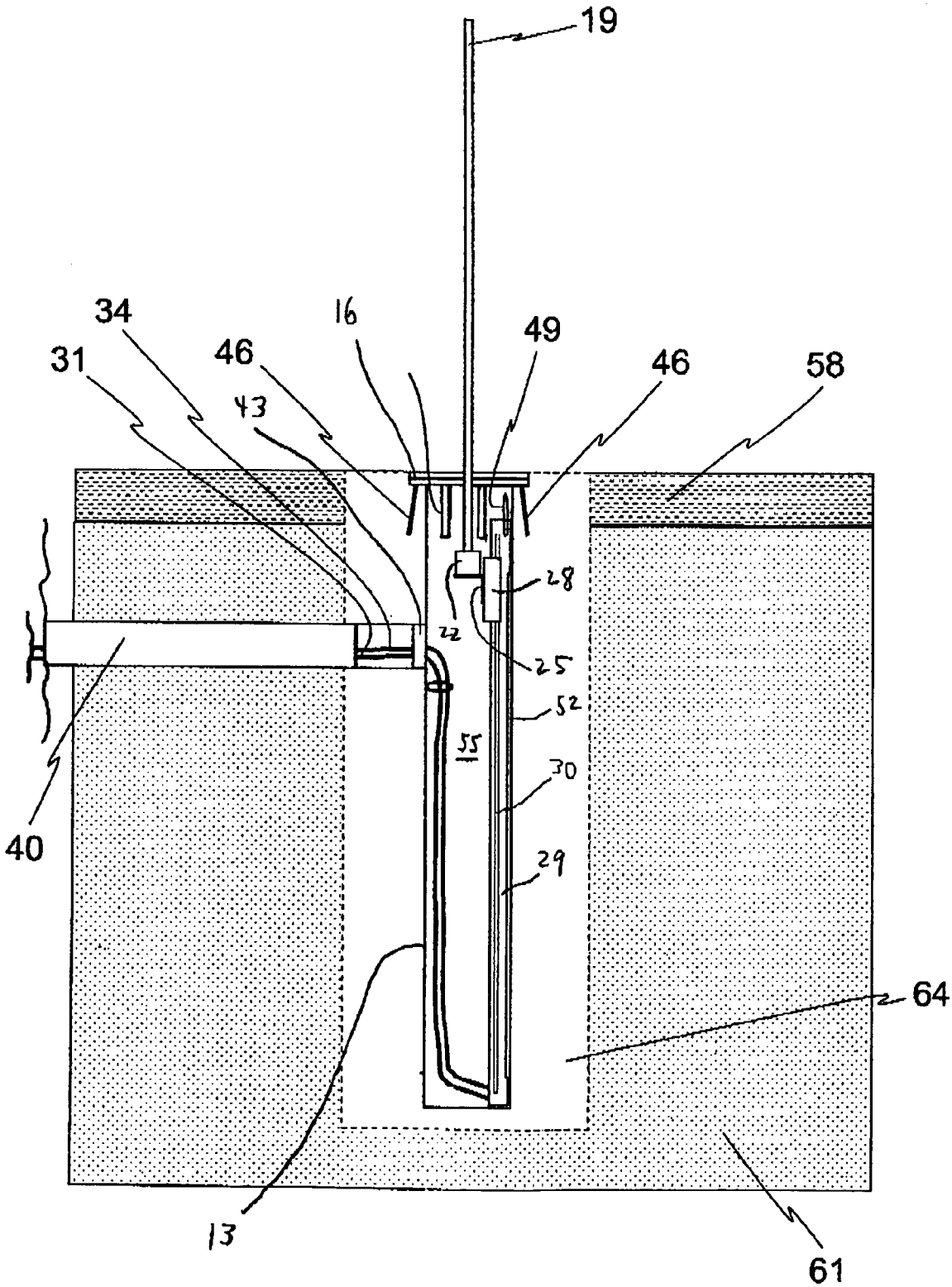
FIG. 2 is a side elevation view of a retractable delineator in a fully extended position and mounted in typical road-type installation.

Turning to FIG. 2, to install the retractable delineator 10, a hole may be excavated in a road surface 58 and through the ground 61 below. Concrete 64 may be placed into the bottom of the hole where upon the housing 13 may be inserted and leveled such that the top plate 16 is level with the road surface 58. Conduit 40 provides a passageway for the air line 31 and the air line 34 from the compressed air source (discussed below) to the delineator 10. The conduit 40 may be attached to a nipple 43 thereby connecting the conduit 40 to the housing 13. Additionally, the air line 31 and the air line 34 may be secured to a side wall of the housing 13 by means of a retaining ring 37.

In addition to providing a pathway for running air lines 31, 34; the conduit 40 provides a passageway for conditioned air to be delivered from a ring compressor 88 through the conduit 40 into the cavity 55 of the retractable delineator 10. The conditioned air provides a positive pressure environment such that debris or water would not be able to enter through a gasket 70 (FIG. 3) in the top plate 16. By continuous delivery of air from the ring compressor 88, the positive pressure environment inside the cavity 55 creates a pressure differential preventing the elements such as salt, dirt, ice, snow and the like from entering inside the cavity 55. As a result, the delineator 10 is not exposed to corrosive elements or moisture which improves the durability and reliability of the unit.

After the housing 13 is positioned and leveled within the opening in the ground, concrete 64 is added to fill the remaining area around the housing 13 such that the plurality of braces 46 engage the concrete 64 to further secure the housing 13 in the hole. After the concrete 64 has cured, the top plate 16 may be removed and the rodless cylinder 29 may be installed. For ease of installation, the air line 31 and the air line 34 may be attached to rodless cylinder 29 outside the delineator 10. Once the conduit connections are made, the rodless cylinder 29 and post 19 may then be inserted into the housing 13 using a handle 49 to slide the rodless cylinder 29 into the slide rails 52. Once the rodless cylinder 29 is seated at the bottom of the housing 13, the top plate 16 may be repositioned and secured to the housing 13 by means of fasteners 67.

Figure 3:
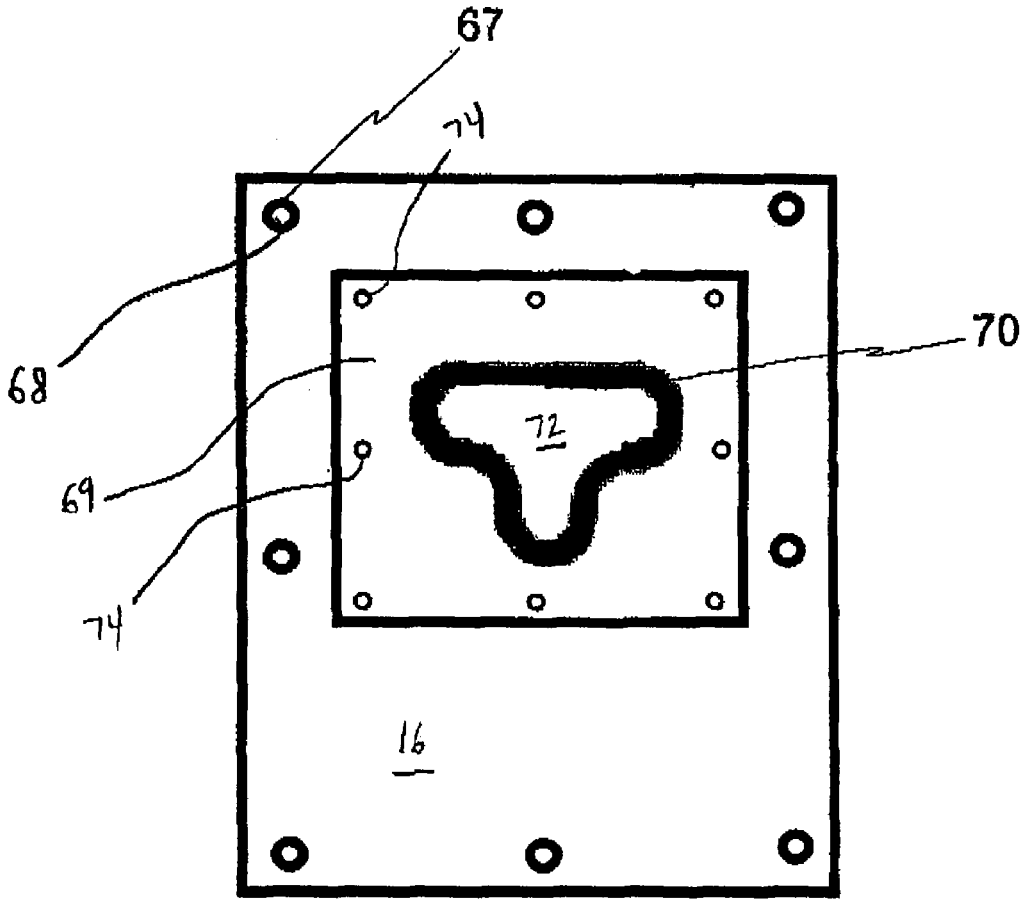
FIG. 3 is a top plan view of the top plate showing possible mounting configurations and a sealing gasket.
Figure 4:
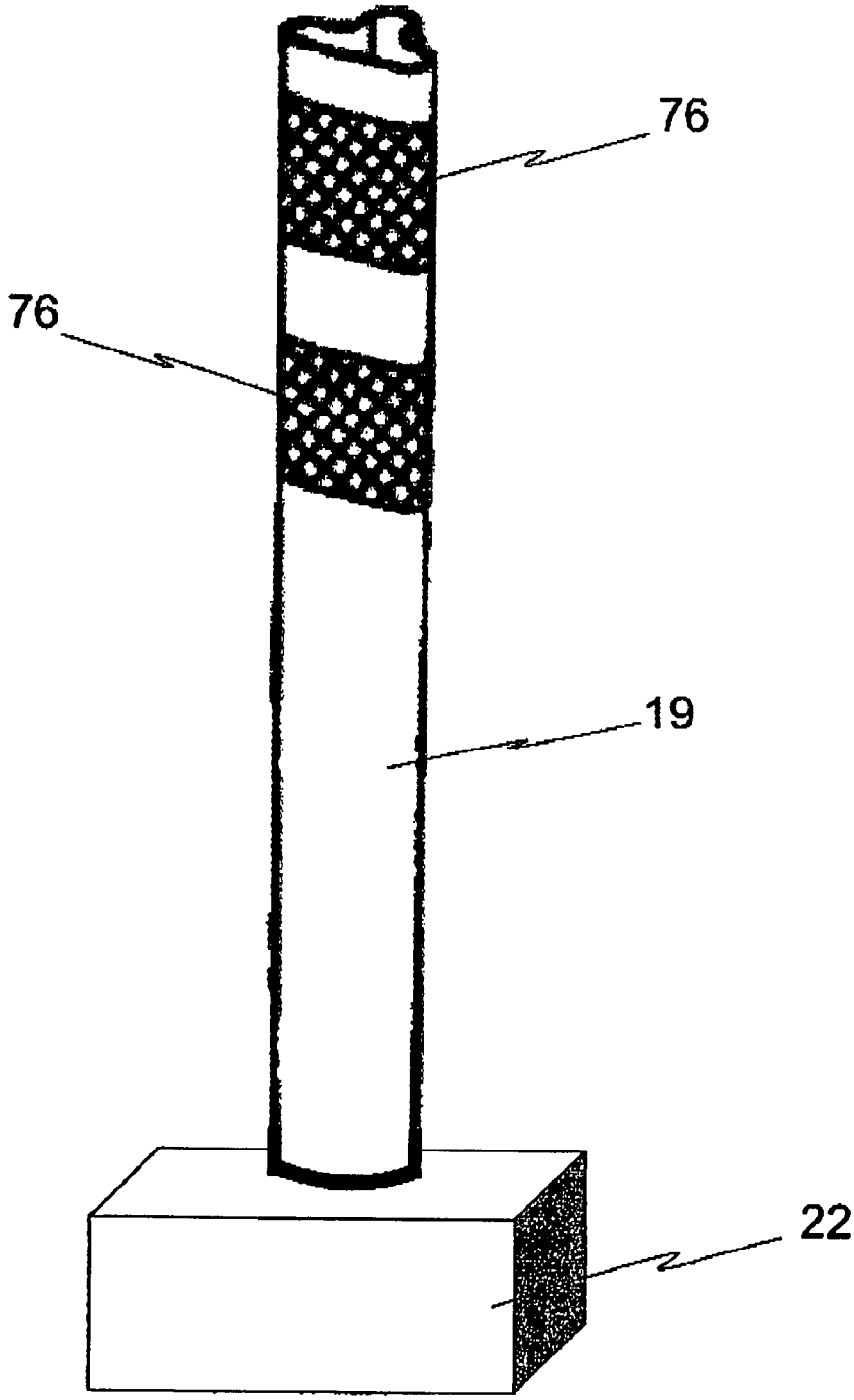
FIG. 4 is a perspective view of a retractable delineator post and base showing possible reflective markings; and, FIG. 5 is a schematic diagram of a system of retractable delineators connected in series.

Turning to FIG. 3, the top plate 16 is shown in greater detail. Fasteners 67 are disposed in openings 68 positioned around the periphery of the plate 16. In the embodiment shown, an adaptor plate 69 is shown in the center of the figure. The adaptor plate 69 has a central opening 72 with a "clover leaf" design to receive a post 19 having a corresponding shape as shown in FIG. 4. The adaptor plate 69 has a plurality of openings 74 disposed around its periphery for attaching plate 69 to plate 16. As will be evident to those of ordinary skill based on this disclosure, other adaptor plates with different shapes for use with different cross-sectional shaped posts (i.e., round, square, oval, etc.) could also be used. Also, the adaptor plate 69 provides versatility for changing the post, but the top plate 16 could also be made from a single piece with an opening in the center for receiving the post 19. The central opening 72 is bordered by a gasket 70. Once the air reaches a certain pressure level inside the cavity 55, it escapes to atmosphere between the post 19 and the gasket 70. However, as discussed above, the pressure differential prevents debris or moisture from entering the delineator 10.

Turning to FIG. 4, the post 19 may be provided with reflective materials 76 for visibility of the post in different lighting conditions.

Figure 5:
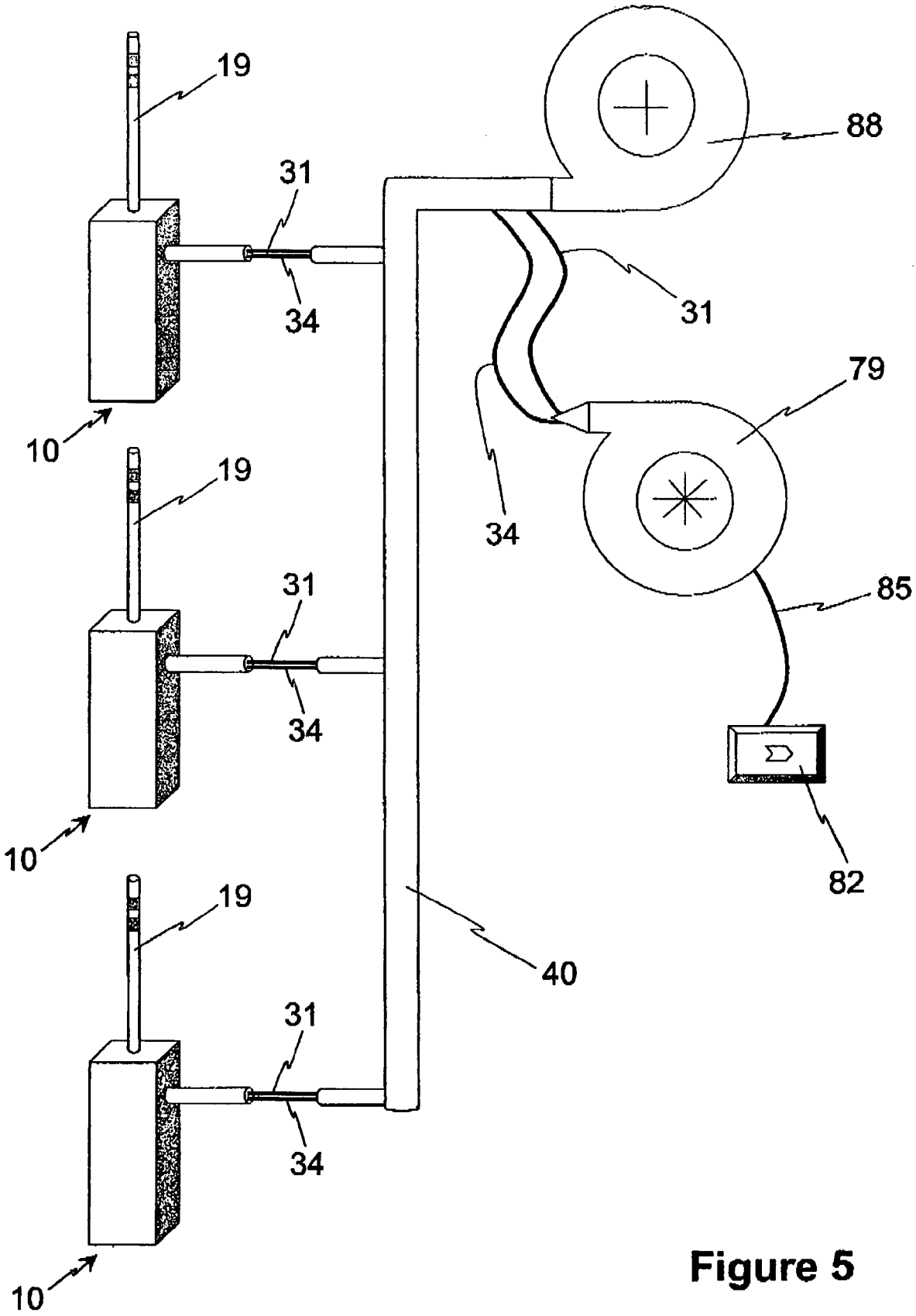

In one example of an embodiment of the invention, the retractable delineator 10 may be arranged as depicted in FIG. 5 where multiple retractable delineators 10 may be installed. In this particular embodiment, compressed air may be generated by a standard compressor 79 and delivered to the retractable delineators 10 via the air lines 31 and via the air lines 34 which are laid through the conduit 40. To operate the retractable delineators, a user may select an appropriate setting on a control pad 82 which would send a signal over a wire 85 to the standard compressor 79 to provide compressed air to the appropriate air line. Additionally, conditioned air would be fed from a ring compressor 88 through the conduit 40 and into the retractable delineator 10 such that the positive pressure environment would be formed in the cavity 55 preventing water and debris from entering.

While the invention has been described in connection with certain embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A retractable delineator, comprising:

a housing having a first end, a second end, and sidewalls defining a cavity and at least one rail attached to at least one sidewall;

a top plate disposed adjacent to the first end of the housing, the top plate having an opening defined therein;

a post mounted inside the housing, the post sized to fit through the opening in the top plate;

a drive system coupled to the post and engaged with the at least one rail and capable of moving the post through the opening in the top plate in a first direction and capable of moving the post in a second direction opposite the first direction;

a conduit in fluid communication with the housing; and, a source of pressurized gas in fluid communication with the housing via the conduit such that the housing is continuously pressurized and a gasket positioned between the top plate and the post and the gasket for preventing water or debris from entering the cavity.

2. The retractable delineator of claim 1, wherein the drive system comprises a pneumatic cylinder.

3. The retractable delineator of claim 2, wherein the cylinder is rodless.

4. The retractable delineator of claim 2, further comprising pneumatic lines disposed through the conduit and connected to the cylinder.

5. The retractable delineator of claim 1, wherein the pressure inside the housing is raised above atmospheric pressure.

6. A retractable delineator, comprising:

a housing having a first end, a second end, and sidewalls defining a cavity;

a top plate disposed adjacent to the first end of the housing, the top plate having an opening;

a cylinder having a reciprocating carriage mounted thereon, the cylinder mounted inside the housing;

a post attached to the carriage and sized to fit through the opening in the top plate and a gasket positioned between the post and top plate;

a conduit in fluid communication with the housing; and, a source of pressurized gas in fluid communication with the housing via the conduit such that the pressurized gas is continuously delivered to the housing via the conduit; and, wherein the housing is continuously pressurized above atmospheric pressure via the source of pressurized gas and the pressured gas for preventing water and debris from entering the housing between the gasket and the post.

7. The retractable delineator of claim 6 further comprising a base joined to the post such that the post extends from the base, and a hollow stub having an opening extends downwardly from the top plate so that that when the post is moved into a fully extended position through the opening the base is surrounded by the hollow stub and wherein in the event the fully extended post is impacted it is capable of breaking away from the base and the hollow stub for preventing the base from moving and damaging the retractable delineator.

8. The retractable delineator of claim 6, wherein the cylinder comprises a pneumatic cylinder.

9. The retractable delineator of claim 6, wherein the cylinder is rodless.

10. The retractable delineator of claim 6, further comprising pneumatic lines disposed through the conduit, the pneumatic lines being disposed in fluid communication with the cylinder.

11. The retractable delineator of claim 6, wherein the housing has at least one rail extending from the at least one sidewall.

12. The retractable delineator of claim 11, wherein the reciprocating carriage is capable of being slidably mounted on the at least one rail.

13. The retractable delineator of claim 12, wherein the cylinder has a handle attached thereto.

14. A method of controlling vehicular traffic, comprising:

providing a housing having a first end, a second end, and sidewalls defining a cavity and mounting at least one rail on at least one of the sidewalls;

providing a top plate disposed adjacent to the first end of the housing, the top plate having an opening and positioning a gasket around the opening;

providing a post mounted inside the housing, the post sized to fit through the opening in the top plate;

providing a drive system coupled to the post and engaging the drive system with the at least one rail and wherein the drive system is capable of moving the post through the opening in the top plate in a first direction and capable of moving the post in a second direction opposite the first direction;

providing a conduit in fluid communication with the housing;

providing a source of pressurized gas in fluid communication with the housing;

pressurizing the housing via the source of pressurized gas and the pressurized gas at a pressure above atmospheric pressure and allowing the pressurized gas to force against the gasket and escape from the cavity such that water and debris are prevented from entering the housing between the gasket and the post; and, actuating the drive system to raise and lower the post in order to control vehicular traffic.

15. The method of claim 14, wherein the drive system comprises a pneumatic cylinder.

16. The method of claim 14, wherein the cylinder is rodless.

17. The method of claim 14, further comprising a plurality of housings for remote control of a plurality of posts.

18. A retractable delineator, comprising:

a housing having a first end, a second end, and sidewalls defining a cavity;

a top plate disposed adjacent to the first end of the housing, the top plate having an opening defined therein;

a post mounted inside the housing, the post sized to fit through the opening in the top plate;

a drive system mounted in the cavity of the housing and the drive system is coupled to the post and capable of moving the post through the opening in the top plate in a first direction and capable of moving the post in a second direction opposite the first direction;

a conduit in fluid communication with the housing; and, a source of pressurized gas in fluid communication with conduit and wherein the cavity defined in the housing is continuously pressurized above atmospheric pressure via the source of pressurized gas and wherein the pressurized gas in the cavity surrounds the drive system, and a gasket positioned between the top plate and the post and the gasket is unsealed when the pressurized gas is pressurized above atmospheric pressure such that the pressurized gas is capable of escaping the cavity to prevent water and debris from entering the cavity defined in the housing.

* * * * *